US007399073B2

(12) United States Patent
Rittgers et al.

(10) Patent No.: US 7,399,073 B2
(45) Date of Patent: Jul. 15, 2008

(54) INK SUPPLY

(75) Inventors: Jon Rittgers, Celbridge (IE); Eduardo Macias, Clonee (IE)

(73) Assignee: Hewlett-Packard Development Company, L.P., Houston, TX (US)

( * ) Notice: Subject to any disclaimer, the term of this patent is extended or adjusted under 35 U.S.C. 154(b) by 356 days.

(21) Appl. No.: 11/132,921

(22) Filed: May 19, 2005

(65) Prior Publication Data

US 2006/0262171 A1 Nov. 23, 2006

(51) Int. Cl.
*B41J 2/175* (2006.01)

(52) U.S. Cl. ..... 347/86; 347/87

(58) Field of Classification Search ..... 347/85, 347/86, 87

See application file for complete search history.

(56) References Cited

U.S. PATENT DOCUMENTS 5,583,549 A * 12/1996 Ujita et al. ..... 347/86
5,631,682 A * 5/1997 Takata ..... 347/86
5,657,058 A * 8/1997 Mochizuki et al. ..... 347/7
5,703,633 A * 12/1997 Gehrer et al. ..... 347/86
5,875,615 A * 3/1999 Ito et al. ..... 53/474
5,892,527 A 4/1999 Harshbarger et al.
6,019,463 A * 2/2000 Waseda ..... 347/86
6,095,643 A 8/2000 Cook et al.
6,109,742 A * 8/2000 Higuma et al. ..... 347/86
6,137,512 A * 10/2000 Higuma et al. ..... 347/86
6,923,530 B2 * 8/2005 Anderson et al. ..... 347/86
7,175,267 B2 * 2/2007 Lui ..... 347/86
2003/0011667 A1 1/2003 Jones et al.
2004/0080591 A1 4/2004 Cho et al.
2004/0201655 A1 10/2004 Miyazawa et al.

FOREIGN PATENT DOCUMENTS

EP 0577439 1/1994
JP 404110157 A * 4/1992 ..... 347/86

OTHER PUBLICATIONS

International Search Report for Application No. PCT/US2006/017392. Report issued Sep. 29, 2006.

* cited by examiner

*Primary Examiner*—Anh T. N. Vo

(57) ABSTRACT

In one embodiment, a foam ink supply includes: a chamber defined by a ceiling, a floor, and a wall between the ceiling and the floor; an outlet from the chamber; and a block of foam only partially filling the chamber, the block of foam positioned adjacent to the outlet and spaced apart from at least part of the wall.

22 Claims, 8 Drawing Sheets

INK SUPPLY

BACKGROUND

Ink cartridges used in inkjet printers include a printhead and one or more chambers that hold the ink. The printhead is a micro-electromechanical part that contains an array of miniature thermal resistors or piezoelectric transducers that are energized to eject small droplets of ink out of an associated array of orifices. The cartridge is mounted in a carriage in the printer and electrically connected to the printer controller. Under the direction of the controller, the cartridge is scanned back and forth across the print medium (usually paper) as resistors or transducers are energized to eject droplets of ink through the orifices on to the medium in the desired pattern.

In many conventional ink cartridges, each ink chamber is filled with a block of foam to hold the ink and to generate backpressure that helps regulate the flow of ink to the printhead. The ink-holding capacity of full blocks of foam that fill the ink chamber, however, is not always fully utilized. Full blocks of foam can also generate too much backpressure, stranding ink in the cartridge. The cost of the foam is a significant part of the overall cost of the ink cartridge.

DRAWINGS

DESCRIPTION

Embodiments of the present invention were developed in an effort to effectively utilize a reduced size foam block in a conventional ink cartridge—reducing the size of the block of foam for holding ink in the ink chamber without changing the size or other characteristics of the molded plastic cartridge housing. Reducing the size of the block of foam helps in lowering the cost of the cartridge and, in some cases, reducing backpressure and allowing better utilization of the ink-holding capacity of the foam. An ink cartridge is also commonly referred to as an ink pen, a print cartridge or an inkjet print head assembly. The exemplary embodiments shown in the figures and described below illustrate but do not limit the invention. Other forms, details, and embodiments may be made and implemented. Hence, the following description should not be construed to limit the scope of the invention, which is defined in the claims that follow the description.

Figure 1:
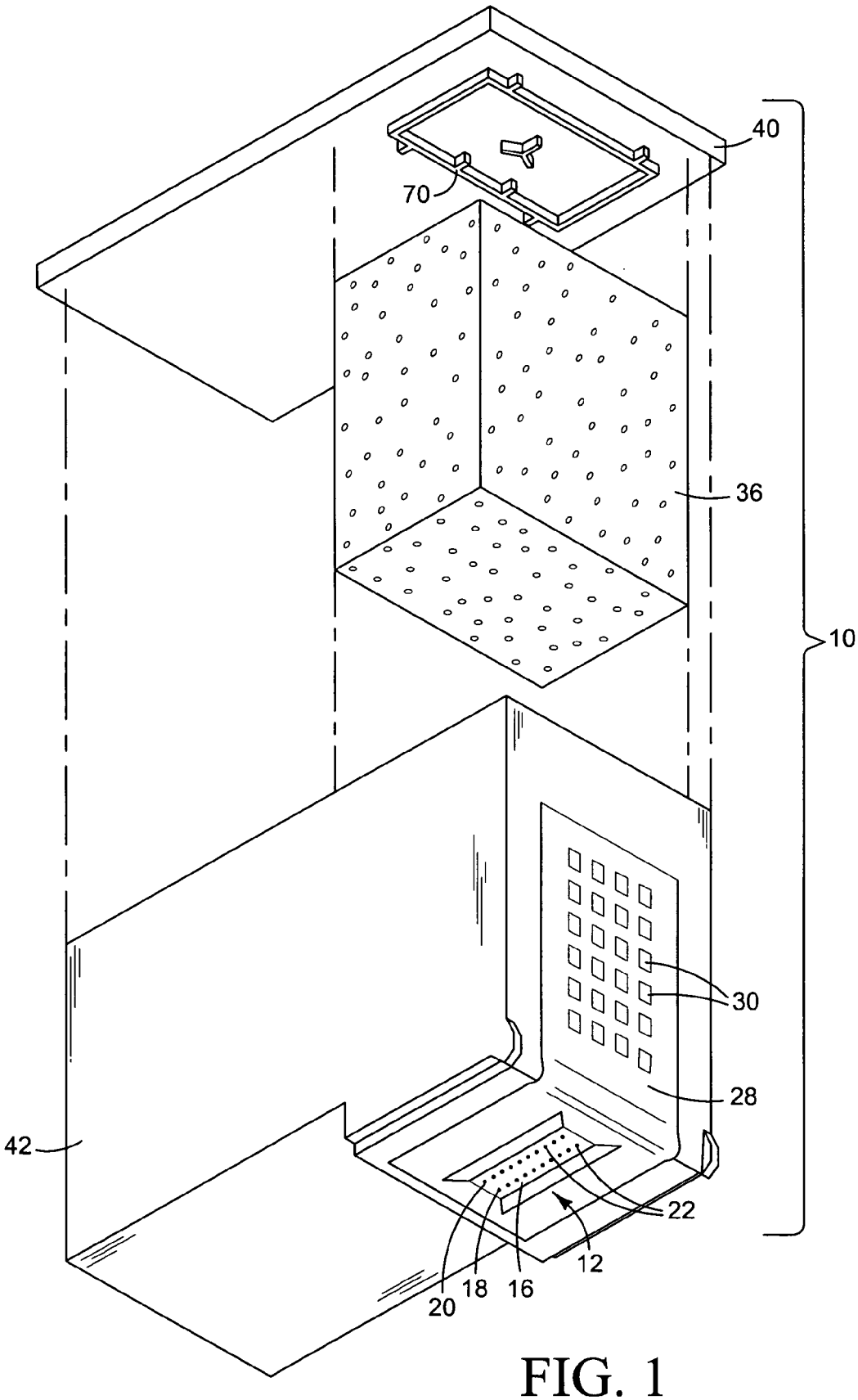
FIG. 1 is a perspective view illustrating an ink cartridge according to an embodiment of the invention.
Figure 3:
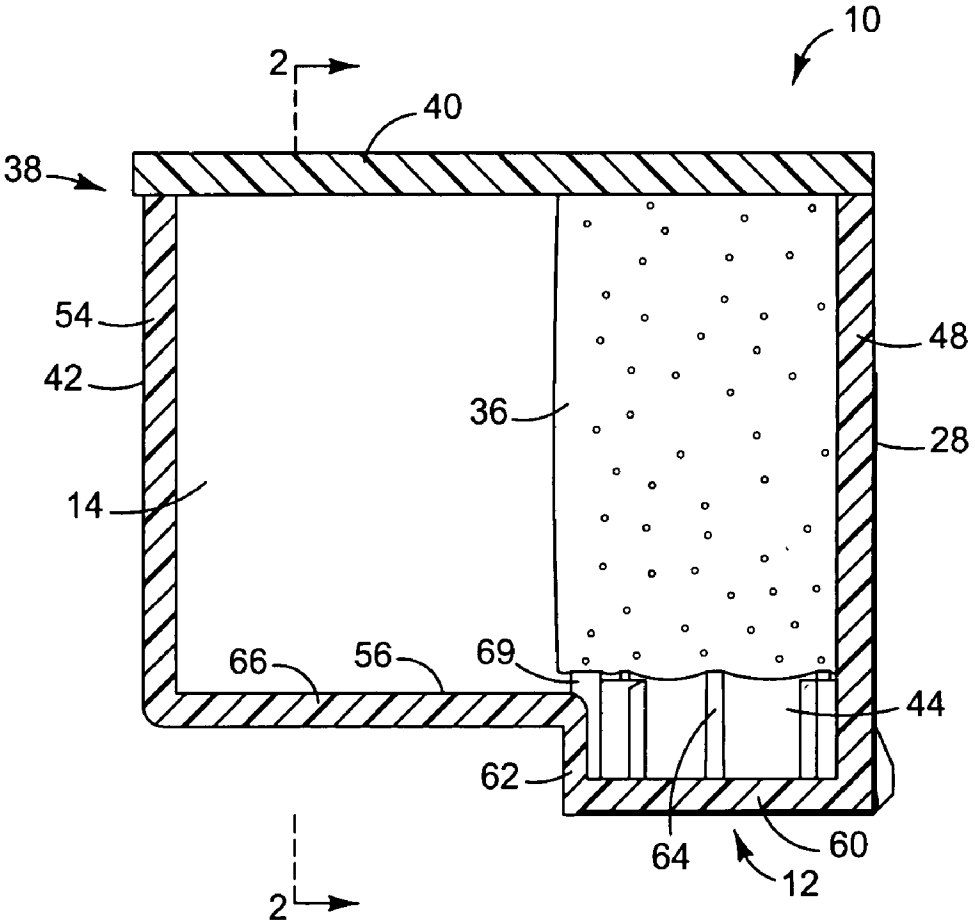
FIGS. 2 and 3 are front and side elevation section views illustrating internal features of the ink cartridge of FIG. 1.
Figure 2:
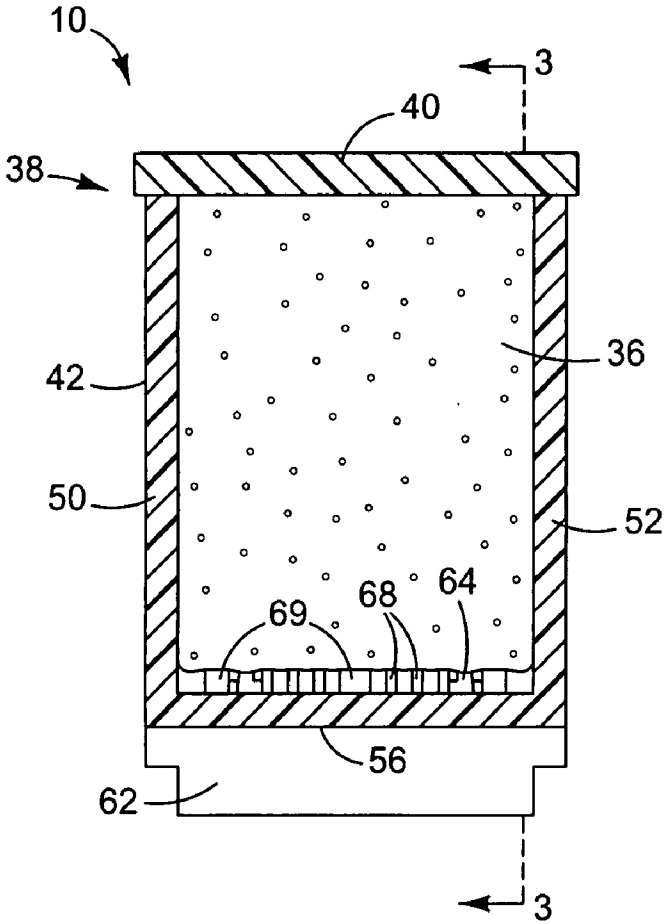
Figure 5:
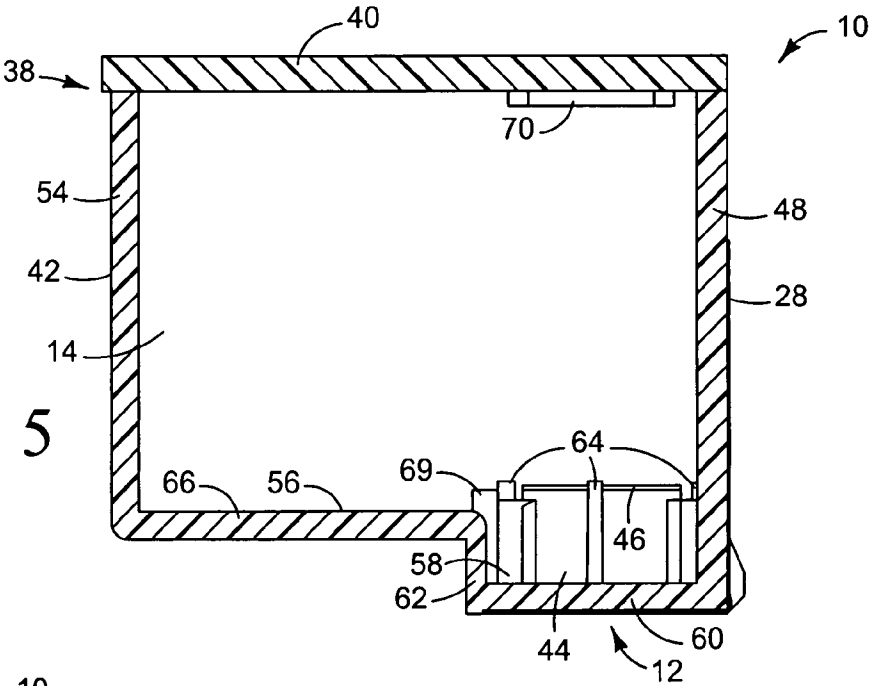
FIGS. 4-6 are front and side elevation and plan section views, respectively, of the ink cartridge of FIG. 1 with the ink holding foam omitted to more clearly illustrate some of the internal features of the ink cartridge.
Figure 6:
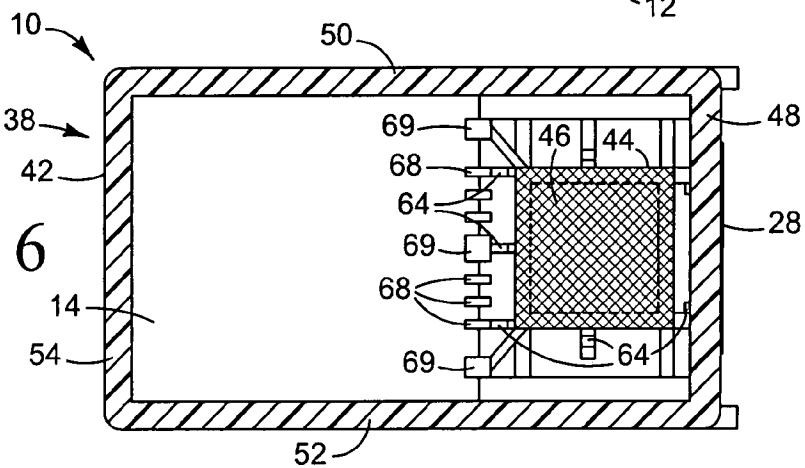
Figure 8:
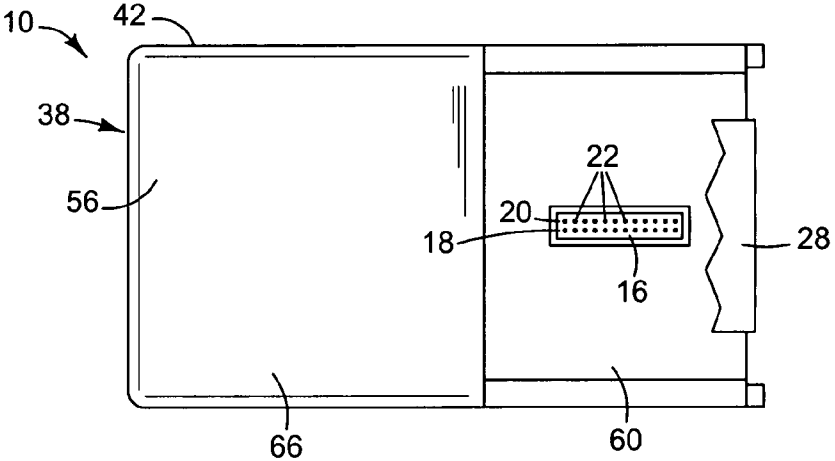
FIG. 8 is a bottom plan view of the cartridge of FIG. 1 showing the ink ejection orifices.
Figure 9:
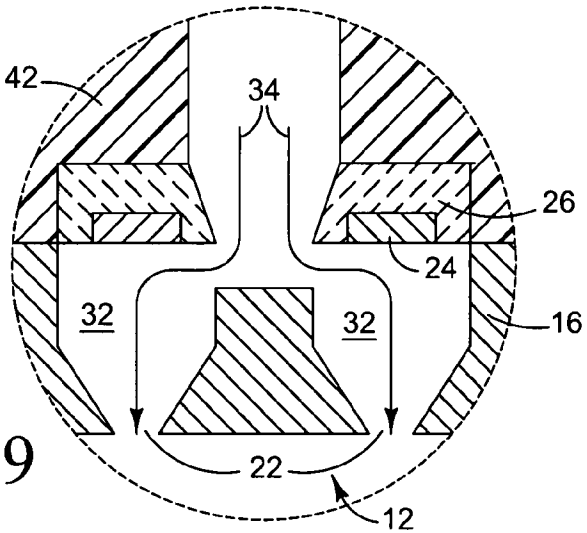
FIG. 9 is a detail section view of a portion of the printhead in the cartridge of FIG. 1.
Figure 7:
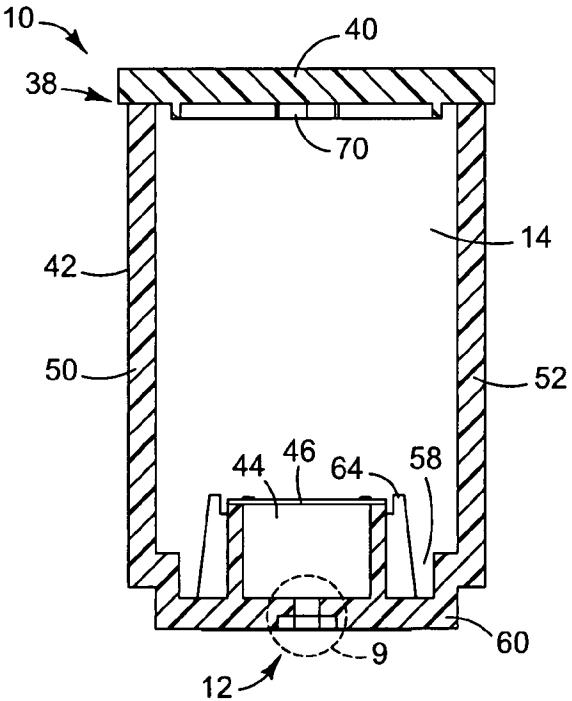
FIG. 7 is an elevation section view of the cartridge of FIG. 1 showing the printhead area of the cartridge.

FIGS. 1-9 illustrate an ink cartridge 10 for a thermal inkjet printer. Embodiments of the invention might also be implemented in an ink cartridge for a piezoelectric inkjet printer or any other inkjet printer in which it might be desirable to use foam or another suitable ink holding material in the ink supply. FIG. 1 is a perspective view of cartridge 10. FIGS. 2-6 are section views of ink cartridge 10. The ink holding foam is omitted from the section views of FIGS. 4-6 to more clearly illustrate some of the internal features of ink cartridge 10. FIG. 7 is an elevation section view showing the printhead area of cartridge 10. FIG. 8 is a bottom plan view of cartridge 10 showing the ink ejection orifices. FIG. 9 is a detail section view of a portion of the printhead in cartridge 10.

Referring first to FIGS. 1 and 7-9, cartridge 10 includes a printhead 12 located at the bottom of cartridge 10 below ink chamber 14. Printhead 12 includes an orifice plate 16 with two arrays 18, 20 of ink ejection orifices 22. In the embodiment shown, each array 18, 20 is a single row of orifices 22. As shown in the detail view of FIG. 9, firing resistors 24 formed on an integrated circuit chip 26 are positioned behind ink ejection orifices 22. A flexible circuit 28 carries electrical traces from external contact pads 30 to firing resistors 24.

When ink cartridge 10 is installed in a printer, cartridge 10 is electrically connected to the printer controller through contact pads 30. In operation, the printer controller selectively energizes firing resistors 24 through the signal traces in flexible circuit 28. When a firing resistor 24 is energized, ink in a vaporization chamber 32 (FIG. 9) next to a resistor 24 is vaporized, ejecting a droplet of ink through an orifice 22 on to the print media. The low pressure created by ejection of the ink droplet and cooling of chamber 32 then draws ink from an ink supply to refill vaporization chamber 32 in preparation for the next ejection. The flow of ink through printhead 12 is illustrated by arrows 34 in FIG. 9.

Referring now also to FIGS. 2-6, ink is held in a foam block 36 in ink chamber 14 formed within a cartridge housing 38. Housing 38, which is typically molded plastic, may be molded as a single unit, molded as two parts (e.g., a lid 40 and a body 42) or constructed of any number of separate parts fastened to one another in the desired configuration. An outlet 44 to printhead 12 is located near the bottom of ink chamber 14. A filter 46 covering outlet 44 may be used to keep contaminants, air bubbles and ink flow surges from entering printhead 12. Ink is held in foam 36 or another suitable porous material to retain the ink at an appropriate backpressure through capillary action. Foam 36 is usually compressed around filter 46 and outlet 44 to increase its capillarity in the region of outlet 44. As ink is depleted from foam 36, the increased capillarity near outlet 44 tends to draw ink from all other portions of foam 36 to maximize the amount of ink drawn from chamber 14.

Figure 4:
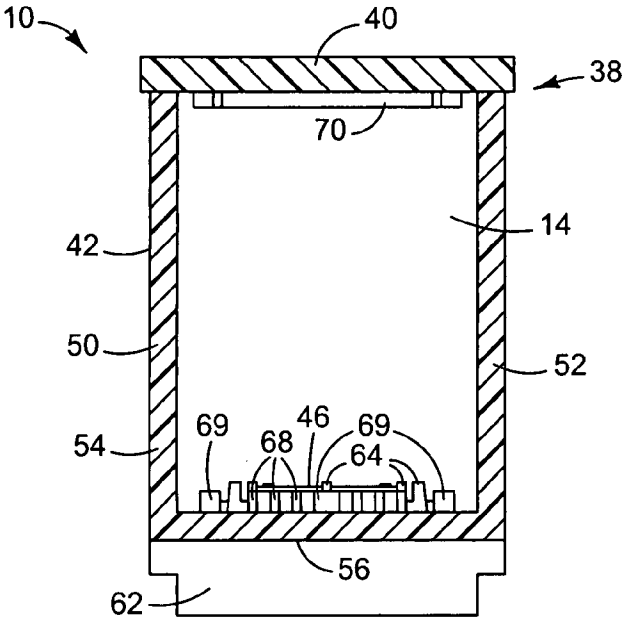

In the embodiment shown in the figures, foam 36 does not fill chamber 14. This "partial-fill" foam configuration may be desirable, for example, to reduce the size of a conventional foam block without also changing the size or other characteristics of the molded plastic cartridge housing, such as housing 38. Although a single color cartridge 10 with only one ink chamber 14 is shown and described, embodiments of the invention are also applicable to tri-color and other multi-chambered cartridges in which a "partial-fill" foam configuration may be used in one or more of the multiple ink chambers. Referring now to FIGS. 4-6, housing body 42 includes a front wall 48, side walls 50, 52, back wall 54 and a floor 56.

Printhead 12 is positioned below outlet 44 in a depression 58 in a front part 60 of floor 56. Depression 58 is formed by a step 62 in floor 56. Filter 46 is affixed to the top of outlet 44 and contained by guides 64 that project up from floor front part 62 at depression 58. In the embodiment shown, outlet 44 projects a short distance into ink chamber 14 so that filter 46 is elevated above a rear part 66 of floor 56. An elevated filter 46 allows the compression of foam 36 around filter 46 to increase the capillarity of foam 36 in the region of outlet 44.

Figure 10:
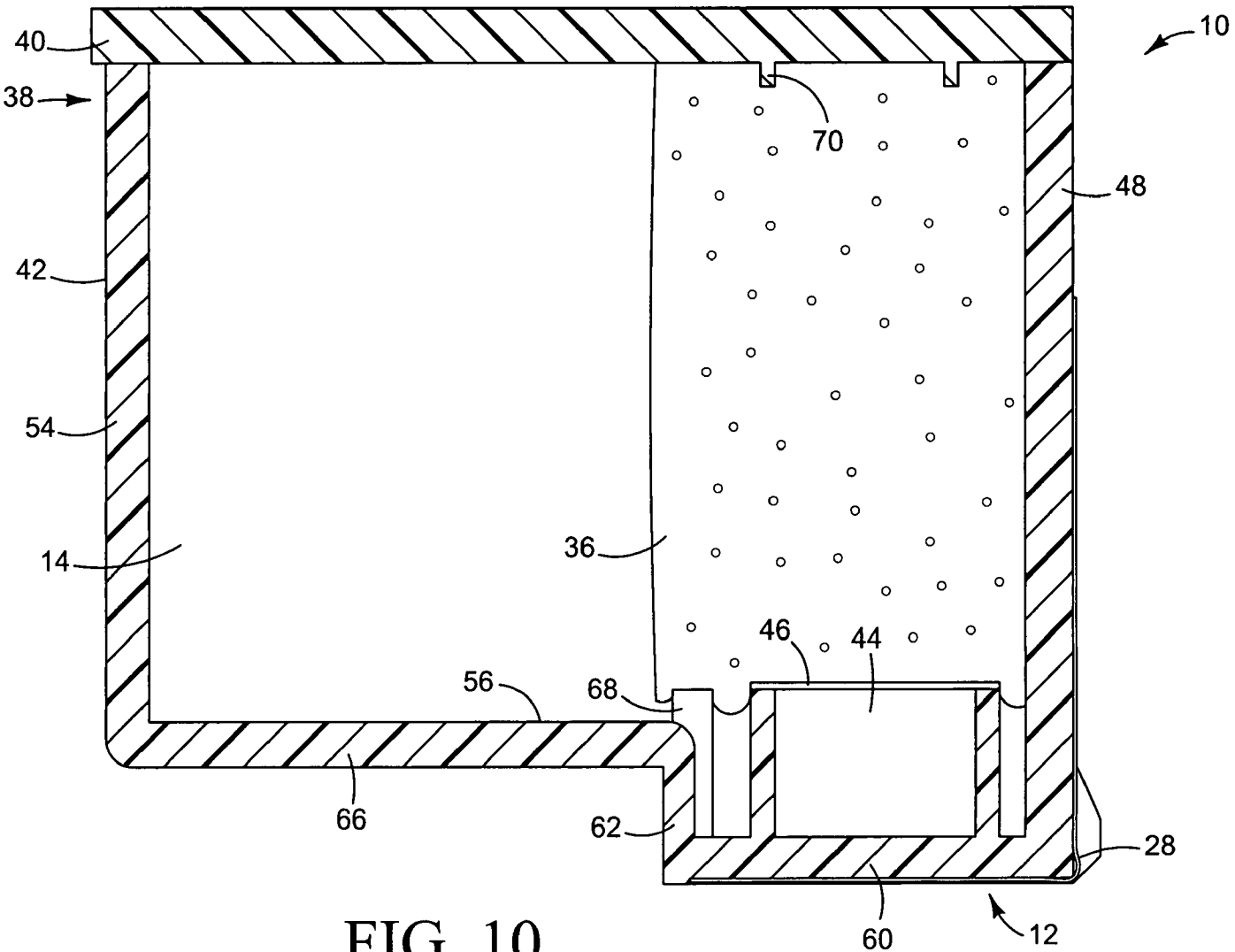
FIG. 10 is an elevation section view of the cartridge of FIG. 1 showing one example of a conventional feature that may be used to help retain a new smaller foam block.

Ribs 68 and posts 69 are formed across floor 56 at step 62. Ribs 68 help wick ink from the area between posts 69 and from floor 56. Posts 69 are ejector pins used in the fabrication of conventional inkjet cartridge housings to remove the housing body from the mold. Foam block 36 is sized and shaped to fit tightly within a space bounded by ejector pin posts 68, front wall 48, sidewalls 50, 52, lid/ceiling 40 and filter 46. FIG. 10 is a detailed view showing foam 36 compressed behind ejector pin posts 68 to create added friction that helps retain foam 36 behind posts 68. The added friction created by a rough surface texture 70 on the bottom on ceiling 40 also helps retain foam 36. Wicking ribs 68 and ejector pin posts 69 illustrate one example of an existing feature that may be used to help retain a new smaller foam block 36 in an otherwise conventional inkjet cartridge 10. In the embodiment shown in FIGS. 2-3 and 10, foam block 36 is held in place by a combination of factors and structural features—foam 36 is tucked behind posts 69, covers ribs 68, and presses against front wall 48, sidewalls 50, 52, ceiling 40, ribs 68 and posts 69.

Figure 11:
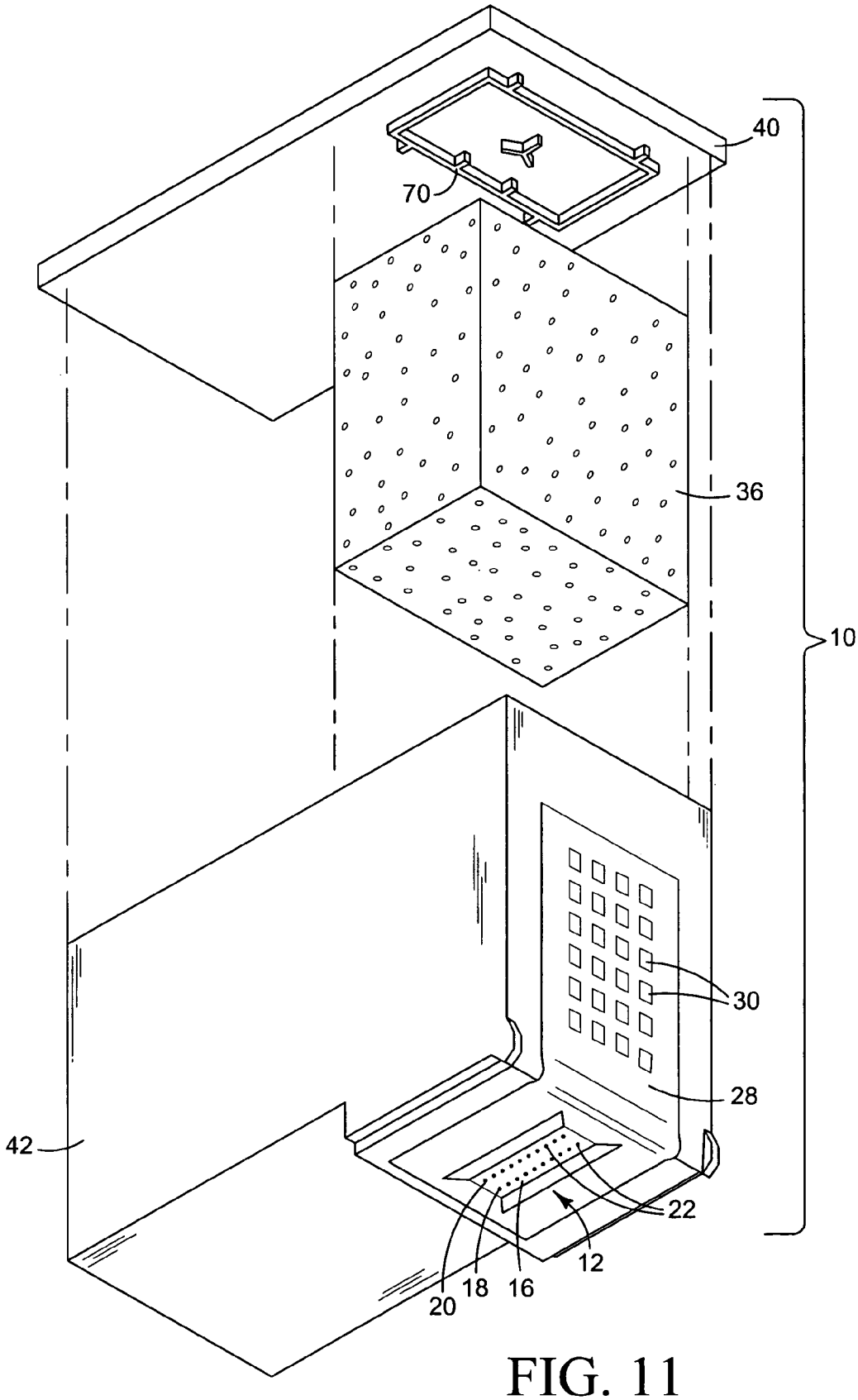
FIG. 11 is a perspective view illustrating an ink cartridge according to another embodiment of the invention.
Figure 13:
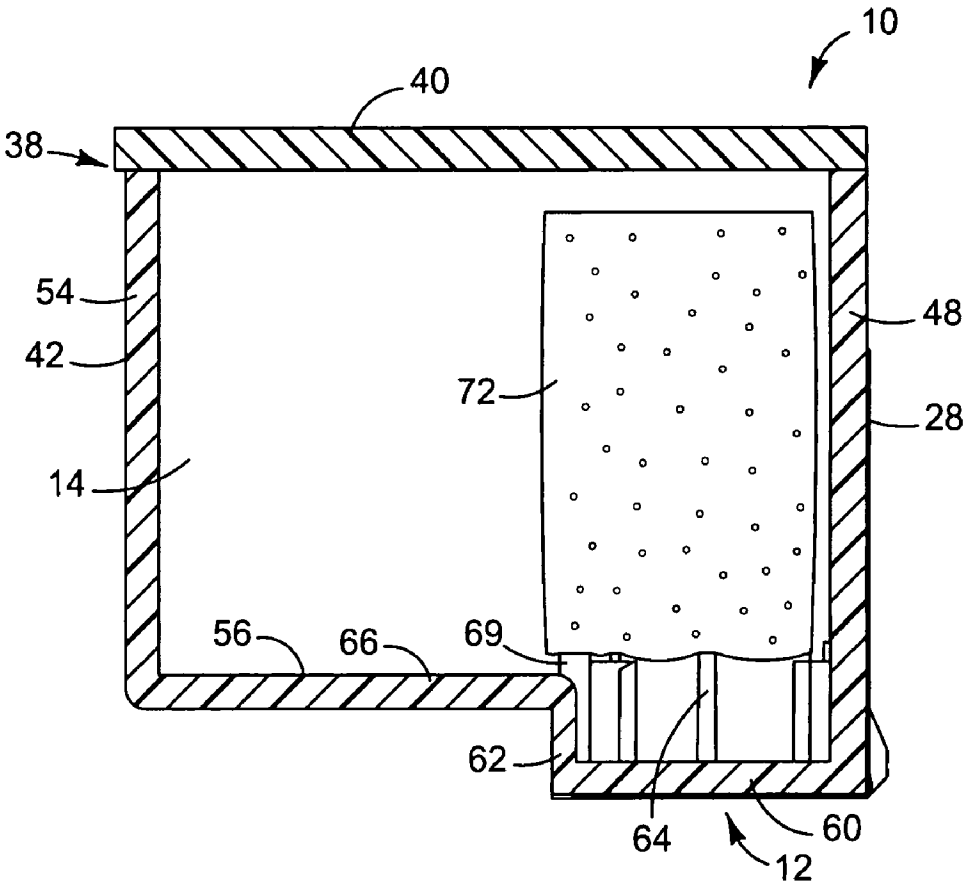
FIGS. 12 and 13 are elevation section views illustrating an ink cartridge according to another embodiment of the invention.
Figure 12:
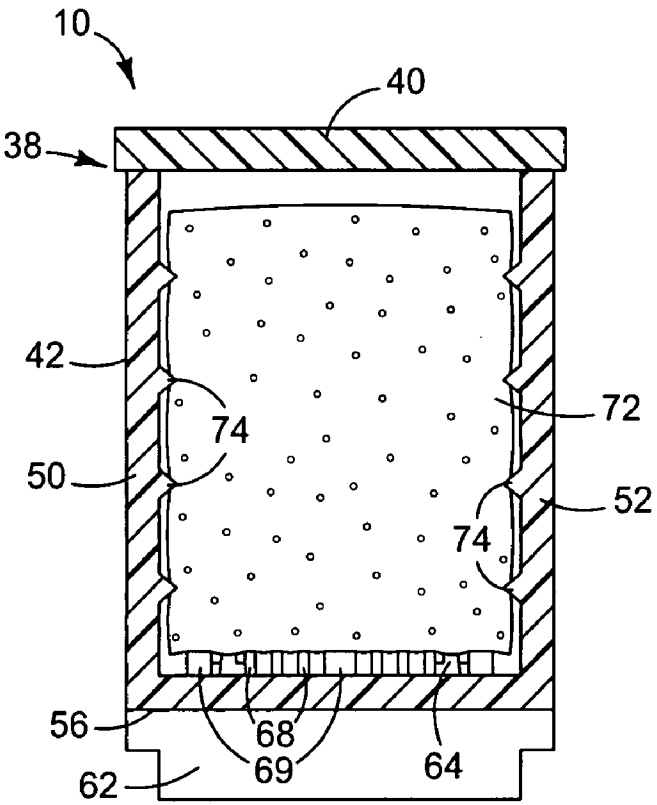
Figure 14:
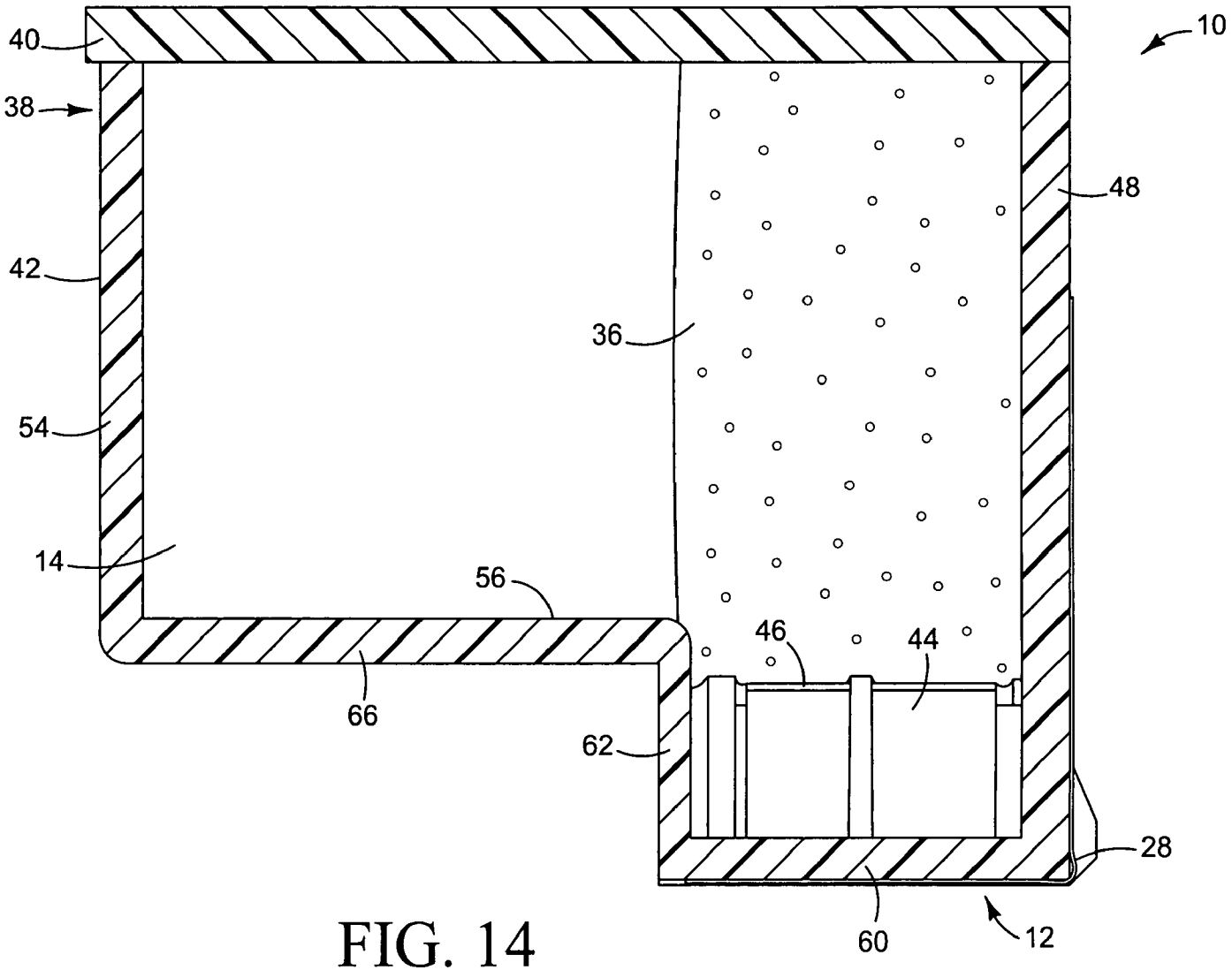
FIG. 14 is an elevation section view illustrating an ink cartridge according to another embodiment of the invention.

Other configurations are possible. For example, in the embodiment shown in FIG. 11, ejector pin posts are omitted or ignored and rough surface texture 70 on ceiling 40 or on the inside of walls 48, 50 and 52 (not shown), or both, retains foam 36 compressed between lid 40 and filter 46. In the embodiment shown in FIGS. 12 and 13, a shorter foam block 72 is retained on just two sides, compressed between spikes 74 protruding from sidewalls 50 and 52. In the embodiment shown in FIG. 14, step 62 in floor 56 is extended to help retain foam 36. A combination of pressure/compression and surface features (steps, bumps, posts, spikes and textures, for example) are used in the various embodiments to retain the foam. The less the walls are involved in holding the foam in place, the more the floor and lid/ceiling will be involved in holding the foam in place, and vice versa.

As noted at the beginning of this Description, the exemplary embodiments shown in the figures and described above illustrate but do not limit the invention. Other forms, details, and embodiments may be made and implemented. Therefore, the foregoing description should not be construed to limit the scope of the invention, which is defined in the following claims.

What is claimed is:

1. A foam ink supply, comprising:
a chamber defined in part by a ceiling;
an outlet from the chamber located opposite the ceiling; and
a block of foam for holding ink in the chamber compressed between the ceiling and the outlet, the block of ink holding material occupying substantially less than a full volume of the chamber and at least one side of the block not in contact with any structural feature in the chamber.

2. The ink supply of claim 1, wherein:
the chamber comprises a generally rectangular chamber defined by the ceiling, a floor and a front wall, a back wall and sidewalls extending between the ceiling and the floor; and
the block of foam is spaced apart from the back wall such that no part of the block of foam contacts the back wall or any structure protruding from the back wall.

3. The ink supply of claim 1, wherein:
two sides of the block are not in contact with any structural feature in the chamber;
the chamber comprises a generally rectangular chamber defined by the ceiling, a floor and a front wall, a back wall and sidewalls extending between the ceiling and the floor; and
the block of foam is spaced apart from the front wall and the back wall such that no part of the block of foam contacts the front wall or the back wall or any structure protruding from the front wall or the back wall.

4. The ink supply of claim 1, further comprising ink held in the block of foam.

5. A foam ink supply, comprising:
a housing having a chamber therein;
an outlet from the chamber;
a short retainer protruding from the housing into a bottom of the chamber adjacent to the outlet; and
a block of foam for holding ink in the chamber, the block of foam positioned adjacent to the outlet and occupying less than half of the chamber, the block compressed between a ceiling of the chamber and the retainer such that only a bottom part of the foam block presses against the retainer, there being no other ink holding material in the chamber.

6. The ink supply of claim 5, wherein the retainer comprises posts protruding from a floor of the housing.

7. The ink supply of claim 5, wherein the retainer comprises a series of ribs protruding from a floor of the housing.

8. The ink supply of claim 5, wherein the retainer comprises a step in a floor of the housing.

9. An ink cartridge for inkjet printing, comprising:
a housing having a chamber therein defined by a ceiling, a floor, and a wall between the ceiling and the floor;
an outlet from the chamber;
a printhead affixed to the housing, the printhead operatively connected to the chamber through the outlet; and
a block of ink holding material in the chamber compressed between the ceiling and the outlet, the block of ink holding material occupying substantially less than a full volume of the chamber and at least one side of the block not in contact with any structural feature in the chamber.

10. The ink cartridge of claim 9, further comprising a filter covering the outlet and wherein the ink holding material is compressed between the ceiling and the filter.

11. The ink cartridge of claim 9, further comprising a filter covering the outlet and a rough surface texture on the ceiling and wherein the ink holding material is compressed between the ceiling and the filter.

12. The ink cartridge of claim 9, wherein the ink holding material comprises foam.

13. The ink cartridge of claim 9, wherein:
the chamber comprises a generally rectangular chamber and the wall comprises a front wall, a back wall and sidewalls; and
the ink holding material is spaced apart from the back wall such that no part of the ink holding material contacts the back wall or any structure protruding from the back wall.

14. The ink cartridge of claim 9, wherein:
two sides of the block are not in contact with any structural feature in the chamber;
the chamber comprises a generally rectangular chamber and the wall comprises a front wall, a back wall and sidewalls; and the ink holding material is spaced apart from the front wall and the back wall such that no part of the ink holding material contacts the front wall or the back wall or any structure protruding from the front wall or the back wall.

15. An ink cartridge for inkjet printing, comprising:

a housing having a chamber therein;

an outlet from the chamber;

a short retainer protruding from the housing into a bottom of the chamber adjacent to the outlet;

a body of ink holding material in the chamber positioned adjacent to the outlet and occupying less than half of the chamber, the body ink holding material compressed between a ceiling of the chamber and the retainer such that only a bottom part of the body of ink holding material presses against the retainer, there being no other ink holding material in the chamber; and a printhead affixed to the housing, the printhead operatively connected to the chamber through the outlet.

16. The ink cartridge of claim 15, wherein the retainer comprises posts protruding from a floor of the housing.

17. The ink cartridge of claim 15, wherein the retainer comprises a series of ribs protruding from a floor of the housing.

18. The ink cartridge of claim 15, wherein the retainer comprises a step in a floor of the housing.

19. An ink cartridge for inkjet printing, comprising:

a housing having a generally rectangular chamber therein defined by a ceiling, a floor, a front wall, a back wall and sidewalls between the ceiling and the floor;

an outlet from the chamber;

a printhead affixed to the housing, the printhead operatively connected to the chamber through the outlet;

a structural feature protruding from the floor of the housing adjacent to the outlet opposite the front wall;

ink holding material only partially filling the chamber such that the ink holding material occupies substantially less than a full volume of the chamber, the ink holding material positioned adjacent to the outlet and the ink holding material retained in the chamber through contact with only the ceiling, the floor, the front wall and the structural feature.

20. A foam ink supply, comprising:

a chamber;

an outlet from the chamber;

a block of foam for holding ink in the chamber, the block of foam positioned adjacent to the outlet, there being no other ink holding material in the chamber; and a means for retaining the foam block in the chamber such that at least two sides of the block of foam are substantially free of contact with any structural feature in the chamber.

21. The ink supply of claim 20, wherein the block of foam comprises a single cube shaped block of foam and the means for retaining the foam block in the chamber such that at least two sides of the block of foam are substantially free of contact with any structural feature comprises a means for retaining the foam block in the chamber such that the top and two opposing sides of the block of foam are substantially free of contact with any structural feature.

22. The ink supply of claim 21, wherein the means for retaining comprises spikes on opposing walls of the chamber protruding into the foam block.

* * * * *